US011708651B2

(12) United States Patent
Lee et al.

(10) Patent No.: US 11,708,651 B2
(45) Date of Patent: Jul. 25, 2023

(54) METHOD FOR KNITTING AND FORMING WEFT-KNITTED FABRIC WITH VARYING THICKNESS BY FLAT KNITTING MACHINE AND WEFT-KNITTED FABRIC THEREOF

(71) Applicant: PAI LUNG MACHINERY MILL CO., LTD., New Taipei (TW)

(72) Inventors: Chih-Chiang Lee, New Taipei (TW); Ruei-Wen Shih, New Taipei (TW); Po-Chun Chen, New Taipei (TW)

(73) Assignee: PAI LUNG MACHINERY MILL CO., LTD., New Taipei (TW)

( * ) Notice: Subject to any disclaimer, the term of this patent is extended or adjusted under 35 U.S.C. 154(b) by 0 days.

(21) Appl. No.: 17/308,504

(22) Filed: May 5, 2021

(65) Prior Publication Data

US 2022/0356615 A1 Nov. 10, 2022

(51) Int. Cl.

| | |
|---|---|
| ***D04B 7/30*** | (2006.01) |
| ***D04B 7/04*** | (2006.01) |
| ***D04B 1/22*** | (2006.01) |

(52) U.S. Cl.

CPC ..... *D04B 7/30* (2013.01); *D04B 1/22* (2013.01); *D04B 7/04* (2013.01)

(58) Field of Classification Search

CPC . D04B 7/04; D04B 7/045; D04B 1/22; D04B 7/30

See application file for complete search history.

(56) References Cited

U.S. PATENT DOCUMENTS 4,332,149 A * 6/1982 Mayer ..... D04B 23/02 66/87
5,582,893 A * 12/1996 B ottger ..... D03D 27/10 428/102
5,589,245 A * 12/1996 Roell ..... D03D 27/10 428/920
5,807,295 A * 9/1998 Hutcheon ..... A61F 13/022 602/8

(Continued)

FOREIGN PATENT DOCUMENTS

CN 102978823 A 3/2013
TW 202028555 A 8/2020

(Continued)

*Primary Examiner* — Danny Worrell

(74) *Attorney, Agent, or Firm* — Muncy, Geissler, Olds & Lowe, P.C.

(57) ABSTRACT

The invention provides a method for knitting and forming a weft-knitted fabric with varying thickness by a flat knitting machine and a weft-knitted fabric thereof. The method is implemented in at least one knitting process of the weft-knitted fabric, comprising steps of: driving the flat knitting machine to knit a basic structure by at least one of two needle beds of the flat knitting machine, and controlling the two needle beds on the flat knitting machine to knit a three-dimensional structure connected with the basic structure. A thickness of the three-dimensional structure is greater than a thickness of the basic structure, the three-dimensional structure comprises two surface layer portions and a supporting portion connected with the two surface layer portions and located between the two surface layer portions. A junction between the three-dimensional structure and the basic structure is without the supporting portion.

4 Claims, 9 Drawing Sheets

(56) References Cited

U.S. PATENT DOCUMENTS

| | | | | |
|---|---|---|---|---|
| 6,156,406 | A * | 12/2000 | Rock | B32B 5/06 428/86 |
| 6,755,052 | B1 * | 6/2004 | Sytz | D04B 1/18 66/196 |
| 7,235,504 | B2 * | 6/2007 | Shirasaki | D04B 21/12 66/196 |
| 7,380,420 | B1 * | 6/2008 | Liu | D04B 21/18 66/196 |
| 7,380,421 | B1 * | 6/2008 | Liu | D04B 21/14 66/196 |
| 7,565,821 | B2 * | 7/2009 | Park | B60N 2/976 66/195 |
| 7,849,715 | B2 * | 12/2010 | Starbuck | A41C 5/00 66/196 |
| 7,913,520 | B1 * | 3/2011 | Chen | D04B 1/16 66/196 |
| 9,375,049 | B2 * | 6/2016 | Hazenberg | D04B 21/165 |
| 9,677,209 | B2 * | 6/2017 | Daube | D04B 21/14 |
| 10,130,129 | B2 * | 11/2018 | Rock | B32B 5/02 |
| 10,662,558 | B2 * | 5/2020 | Vanwelden | D04B 1/102 |
| 10,851,482 | B2 * | 12/2020 | Aceves Tinajero | D04B 1/102 |
| 11,299,829 | B2 * | 4/2022 | Meir | D04B 7/30 |
| 2006/0185401 | A1 * | 8/2006 | Shirasaki | D04B 21/14 66/203 |
| 2008/0006060 | A1 * | 1/2008 | Park | F25B 21/04 66/170 |
| 2016/0289872 | A1 * | 10/2016 | Kieren | D04B 21/20 |
| 2020/0002855 | A1 * | 1/2020 | Aristizabal | D04B 1/12 |
| 2020/0181813 | A1 * | 6/2020 | Meir | D04B 15/362 |
| 2020/0354867 | A1 * | 11/2020 | Mueller | B68G 7/02 |

FOREIGN PATENT DOCUMENTS

| | | | |
|---|---|---|---|
| TW | 202028557 | A | 8/2020 |
| TW | 202028558 | A | 8/2020 |
| TW | 1707074 | B | 10/2020 |

* cited by examiner

METHOD FOR KNITTING AND FORMING WEFT-KNITTED FABRIC WITH VARYING THICKNESS BY FLAT KNITTING MACHINE AND WEFT-KNITTED FABRIC THEREOF

FIELD OF THE INVENTION

The invention relates to a method for knitting to form a fabric with varying thickness and a fabric thereof, and more particularly to a method for knitting and forming a weft-knitted fabric with varying thickness by a flat knitting machine and a weft-knitted fabric thereof.

BACKGROUND OF THE INVENTION

Although three-dimensional fabrics have been invented for a long time, even though techniques of making three-dimensional fabrics with varying thickness have been developed, such as disclosed in CN102978823A, three-dimensional fabrics are always knitted independently. If the clothing design has a thick pad part formed by a three-dimensional fabric and a cloth surface part formed by a general knitted fabric, it is necessary to knit the three-dimensional fabric and the general knitted fabric separately, and then combine the two by sewing and splicing or using chemical adhesives. However, combining the three-dimensional fabric and the general knitted fabric by sewing and splicing will form spliced edges, which will greatly reduce the comfort of clothes. In addition, clothing with thick pads is generally used as a close-fitting clothing, and the stuffiness caused by long-term wearing may produce qualitative changes in chemical adhesives, which may affect the wearer's skin. Furthermore, chemical adhesives are not natural products, using excessively will also affect the environment.

SUMMARY OF THE INVENTION

A main object of the invention is to solve the problems of the conventional weft-knitted fabrics that is incapable of being knitted integrally to produce a three-dimensional structure and required to be processed afterwards.

In order to achieve the above object, the invention provides a method for knitting and forming a weft-knitted fabric with varying thickness by a flat knitting machine, the method comprises steps of:

driving the flat knitting machine to knit a basic structure by at least one of two needle beds of the flat knitting machine, wherein the basic structure is selected from a single-layer fabric or a double-layer fabric; and controlling the two needle beds on the flat knitting machine to knit a three-dimensional structure connected with the basic structure, wherein a thickness of the three-dimensional structure is greater than a thickness of the basic structure, the three-dimensional structure comprises two surface layer portions and a supporting portion connected with the two surface layer portions and located between the two surface layer portions, and a junction between the three-dimensional structure and the basic structure is without the supporting portion.

In one embodiment, the flat knitting machine is controlled to be temporarily suspended from feeding a supporting yarn at the junction between the three-dimensional structure and the basic structure, and the supporting yarn is fed to form the supporting portion after the two surface layer portions are knitted with a plurality of stitches.

In one embodiment, during a process of knitting the supporting portion, during a process of knitting the supporting portion, the flat knitting machine drives two knock-over bits of the two needle beds to displace and change a size of a mouth of the flat knitting machine, and a height of the supporting portion is not a fixed value.

In one embodiment, when the basic structure is the double-layer fabric, two fabric surfaces of the double-layer fabric are closely attached to each other by tuck knitting or transfer knitting through the flat knitting machine.

In one embodiment, when the basic structure is the double-layer fabric, the flat knitting machine feeds a cross-linking yarn to enable two fabric surfaces of the double-layer fabric closely attaching to each other by an action of the cross-linking yarn, and the cross-linking yarn is without supporting capability.

In addition to the foregoing, the invention further provides a weft-knitted fabric with varying thickness comprising at least one basic structure and at least one three-dimensional structure connected with the basic structure. The basic structure is selected from a single-layer fabric or a double-layer fabric. A thickness of the three-dimensional structure is greater than a thickness of the basic structure, the three-dimensional structure comprising two surface layer portions and a supporting portion connected with the two surface layer portions and located between the two surface layer portions, and a junction between the three-dimensional structure and the basic structure is without the supporting portion.

In one embodiment, the supporting portion is formed by at least one supporting yarn.

In one embodiment, a height of the supporting portion is not a fixed value.

Accordingly, compared with the conventional techniques, the invention has the following features: the weft-knitted fabric of the invention has the basic structure and the three-dimensional structure during knitting, through the three-dimensional structure generating varying thickness, conventional processing procedure of pasting three-dimensional objects afterwards is eliminated; furthermore, a position where the weft-knitted fabric of the invention forms the three-dimensional structure is not limited, and can be adjusted according to design.

DETAILED DESCRIPTION OF THE PREFERRED EMBODIMENTS

The detailed description and technical contents of the invention are described below with reference to the drawings.

Figure 1:
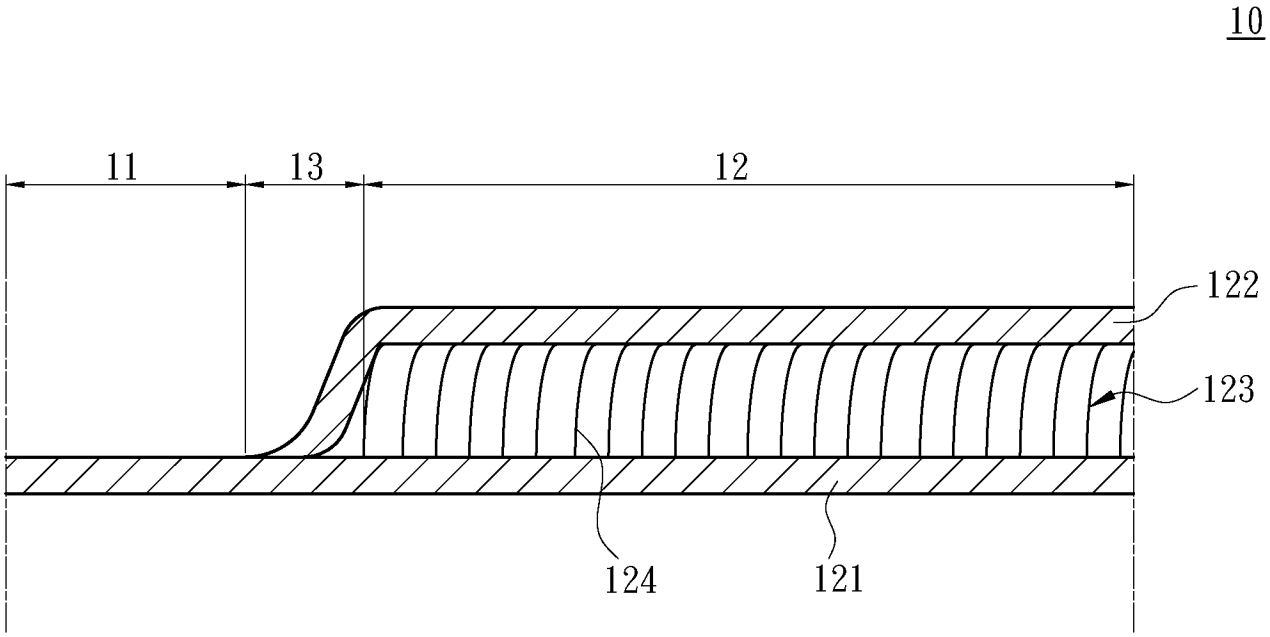
FIG. 1 is a structural diagram of a first embodiment of a weft-knitted fabric of the invention.
Figure 2:
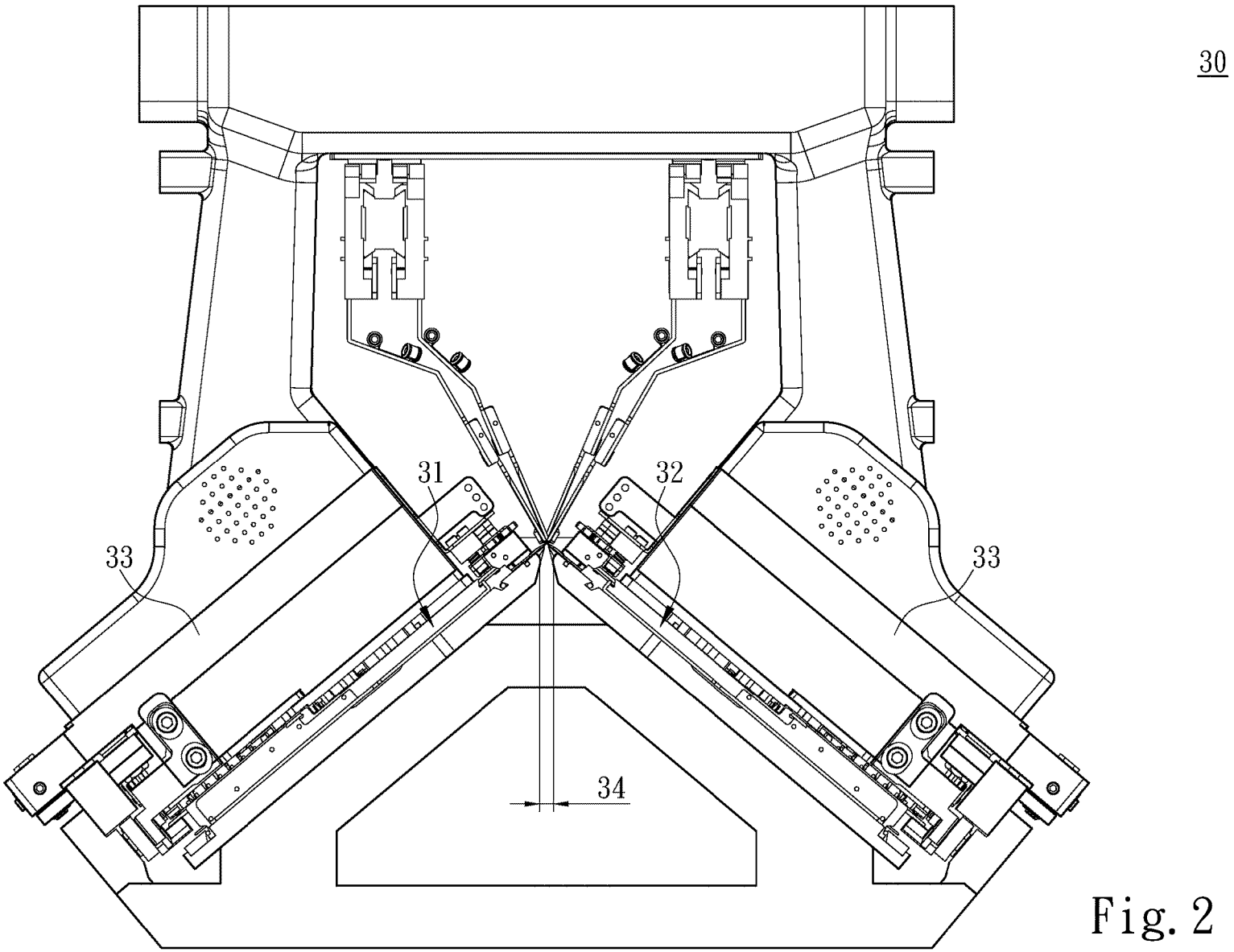
FIG. 2 is a structural diagram of a flat knitting machine knitting the weft-knitted fabric.

Please refer to FIG. 1. The invention provides a weft-knitted fabric 10 with varying thickness. The weft-knitted fabric 10 is knitted by a flat knitting machine 30 (as shown in FIG. 2). The weft-knitted fabric 10 comprises at least one basic structure 11 and at least one three-dimensional structure 12. The basic structure 11 is a general fabric structure without support function. Specifically, the basic structure 11 can be a single-layer fabric or a double-layer fabric. Structures of the single-layer fabric and the double-layer fabric are known to those having ordinary skill in the art, and thus will not be described here. On the other hand, the three-dimensional structure 12 and the basic structure 11 are integrally knitted, that is, the three-dimensional structure 12 is not connected by splicing or other methods after the basic structure 11 is knitted. A thickness of the three-dimensional structure 12 is greater than a thickness of the basic structure 11, so when observing the weft-knitted fabric 10 laterally (as viewed from a visual angle in FIG. 1), changes in thickness can be found. It should be understood that varying thickness or changes in thickness referred to in this specification is not thickness formed by stacking yarn layers, but changes produced when being observed laterally. In addition, the three-dimensional structure 12 comprises two surface layer portions 121, 122 and a supporting portion 123 connected with the two surface layer portions 121, 122 and located between the two surface layer portions 121, 122, and a junction between the three-dimensional structure 12 and the basic structure 11 is without the supporting portion 123. Furthermore, in order to form a thickness of the three-dimensional structure 12, the three-dimensional structure 12 is formed by at least one supporting yarn 124, wherein the supporting yarn 124 deforms when at least one of the two surface layer portions 121, 122 is pressed by force. The three-dimensional structure 12 can be regarded as a thick pad directly formed on the weft-knitted fabric 10. Therefore, the weft-knitted fabric 10 of the invention can be used as a breast pad in women's clothing or a cushion pad in sportswear.

Figure 3:
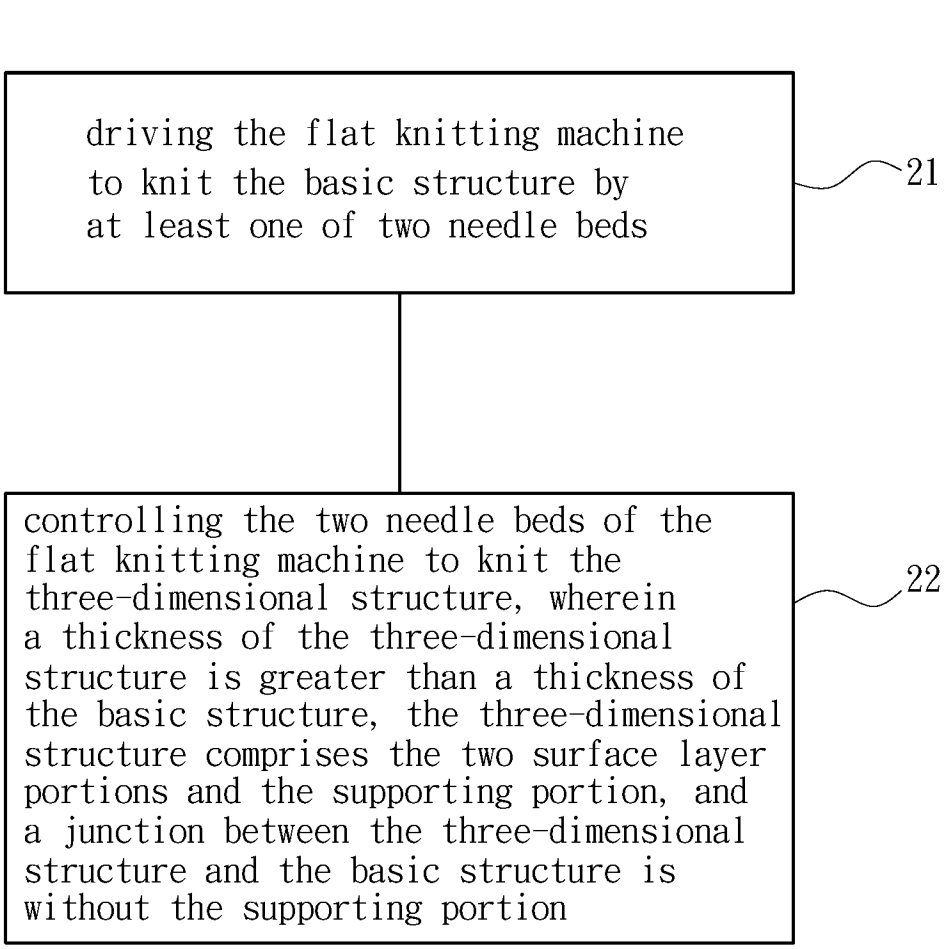
FIG. 3 is a flow chart of a method of the invention.

Please also refer to FIG. 1, FIG. 2 and FIG. 3. In addition to the foregoing, the invention also provides a method 20. In the method 20, the flat knitting machine 30 knits the weft-knitted fabric 10. The method 20 comprises steps of:

step 21: driving the flat knitting machine 30 to knit the basic structure 11 by at least one of two needle beds 31, 32 of the flat knitting machine 30; and step 22: controlling the two needle beds 31, 32 of the flat knitting machine 30 to knit the three-dimensional structure 12, wherein a thickness of the three-dimensional structure 12 is greater than a thickness of the basic structure 11, the three-dimensional structure 12 comprises the two surface layer portions 121, 122 and the supporting portion 123, and a junction between the three-dimensional structure 12 and the basic structure 11 is without the supporting portion 123.

Figure 4:
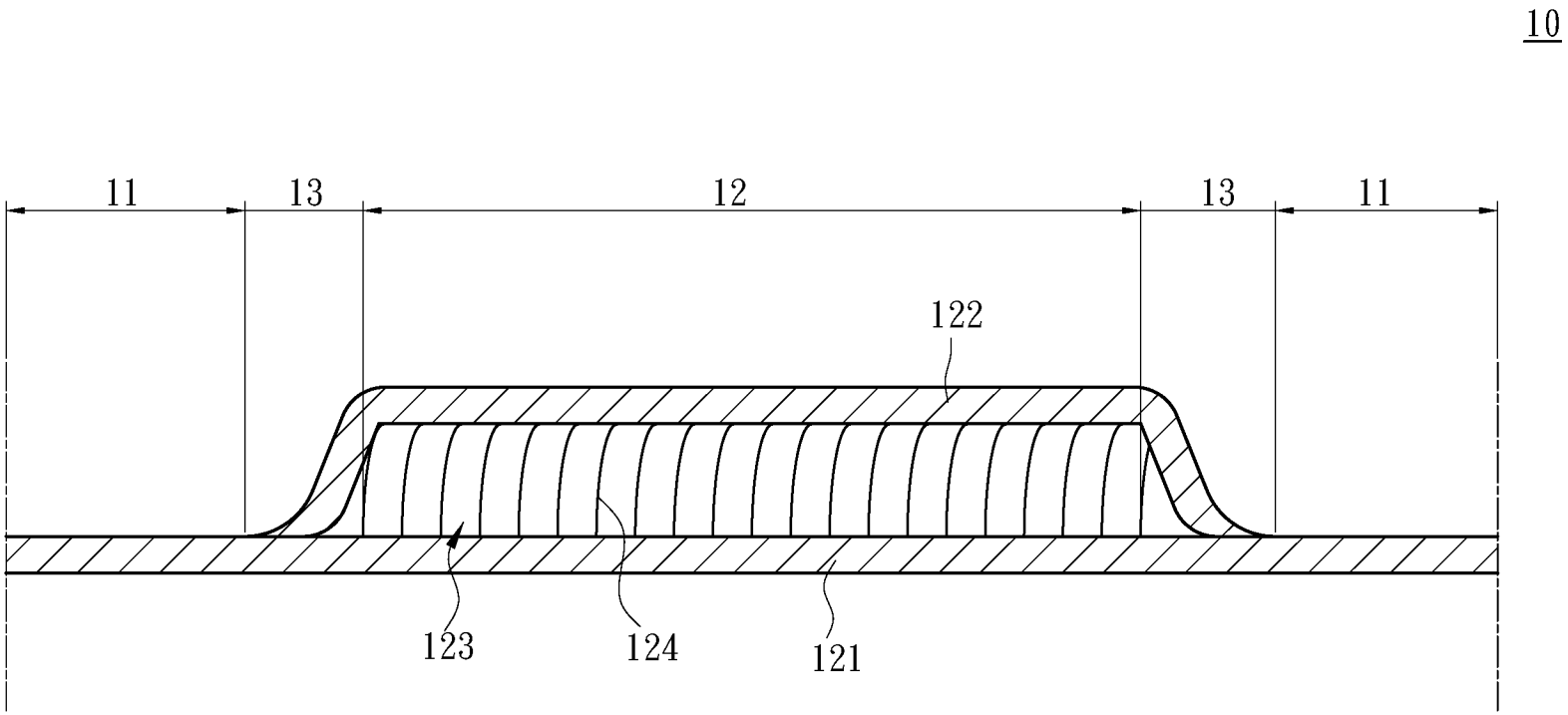
FIG. 4 is a structural diagram of a second embodiment of the weft-knitted fabric of the invention.
Figure 5:
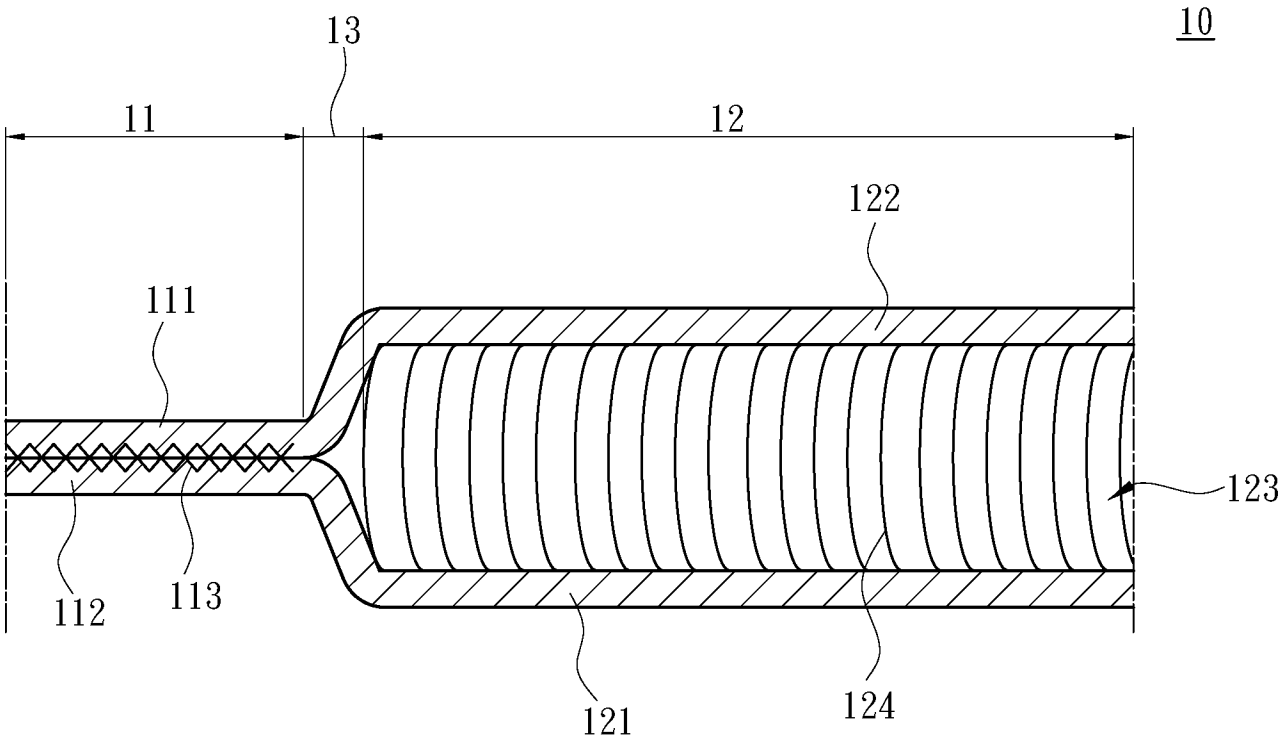
FIG. 5 is a structural diagram of a third embodiment of the weft-knitted fabric of the invention.

Hereinafter, the basic structure 11 is used as the single-layer fabric to explain the method 20, and it is assumed that the flat knitting machine 30 is ready to knit the basic structure 11 (the step 21). A machine head 33 on the flat knitting machine 30 drives one of the two needle beds 31, 32 to knit the basic structure 11 based on setting of a knitting process. When entering a process for knitting the three-dimensional structure 12 of the knitting process, the machine head 33 drives the two needle beds 31, 32 to knit the two surface layer portions 121, 122. At this time, one of the two surface layer portions 121 (or 122) is continuously knitted and formed from the basic structure 11, the other of the two surface layer portions 122 (or 121) is knitted and formed at this point of time. When the surface layer portion 122 is formed initially, the flat knitting machine 30 is set to use transfer knitting technique or tuck knitting technique to connect the surface layer portion 121 with the basic structure 11. Further, the flat knitting machine 30 is controlled to be temporarily suspended from feeding the supporting yarn 124 at a junction 13 between the three-dimensional structure 12 and the basic structure 11, and the supporting yarn 124 is fed to form the supporting portion 123 after the two surface layer portions 121, 122 are knitted with a plurality of stitches. Therefore, the weft-knitted fabric 10 of the invention is a bag-like structure at the junction 13 between the three-dimensional structure 12 and the basic structure 11. In one embodiment, a point of time of feeding the supporting yarn 124 is after several stitches of the two surface layer portions 121, 122 are knitted. A number of stitches temporarily suspended to be knitted can be adjusted based on characteristics of the weft-knitted fabric 10. After the supporting yarn 124 participates in the knitting process, the supporting portion 123 is formed between the two surface layer portions 121, 122. The supporting portion 123 prevents the two surface layer portions 121, 122 from being closely attached to each other, so that the three-dimensional structure 12 is visually thicker than the basic structure 11. It should be understood that the method 20 of the invention is not limited to be ended immediately after completion of knitting of the three-dimensional structure 12. According to fabric pattern design of the weft-knitted fabric 10, the basic structure 11 is knitted again after the three-dimensional structure 12 is completed with knitting, as shown in FIG. 4.

Please refer to FIG. 2, FIG. 3, FIG. 4 and FIG. 5. Hereinafter, the basic structure 11 is used as the double-layer fabric to explain the method 20, and it is assumed that the flat knitting machine 30 is ready to knit the basic structure 11 (the step 21). The machine head 33 simultaneously drives the two needle beds 31, 32 to knit the basic structure 11 based on setting of a knitting process and to produce two fabric surfaces 111, 112 that constitute the double-layer fabric. In the process of knitting the two fabric surfaces 111, 112, the flat knitting machine 30 is set to use transfer knitting technique, tuck knitting technique, or a method of additionally feeding a cross-linking yarn 113, so that the two fabric surfaces 111, 112 are cross-linked and closely attached to each other. When entering a process for knitting the three-dimensional structure 12 of the knitting process, the two surface layer portions 121, 122 are continuously knitted from the two fabric surfaces 111, 112. It should be noted that at a junction 13 of converting from the basic structure 11 to the three-dimensional structure 12 does not comprises any structure to connect the two surface layer portions 121, 122. In technical terms of the industry, the supporting portion 123 is implemented with drop stitches at a junction between the basic structure 11 and the three-dimensional structure 12. Afterwards, the supporting yarn 124 is fed to knit the three-dimensional structure 12, knitting of the three-dimensional structure 12 is the same as described above and thus will not be repeated.

Figure 6:
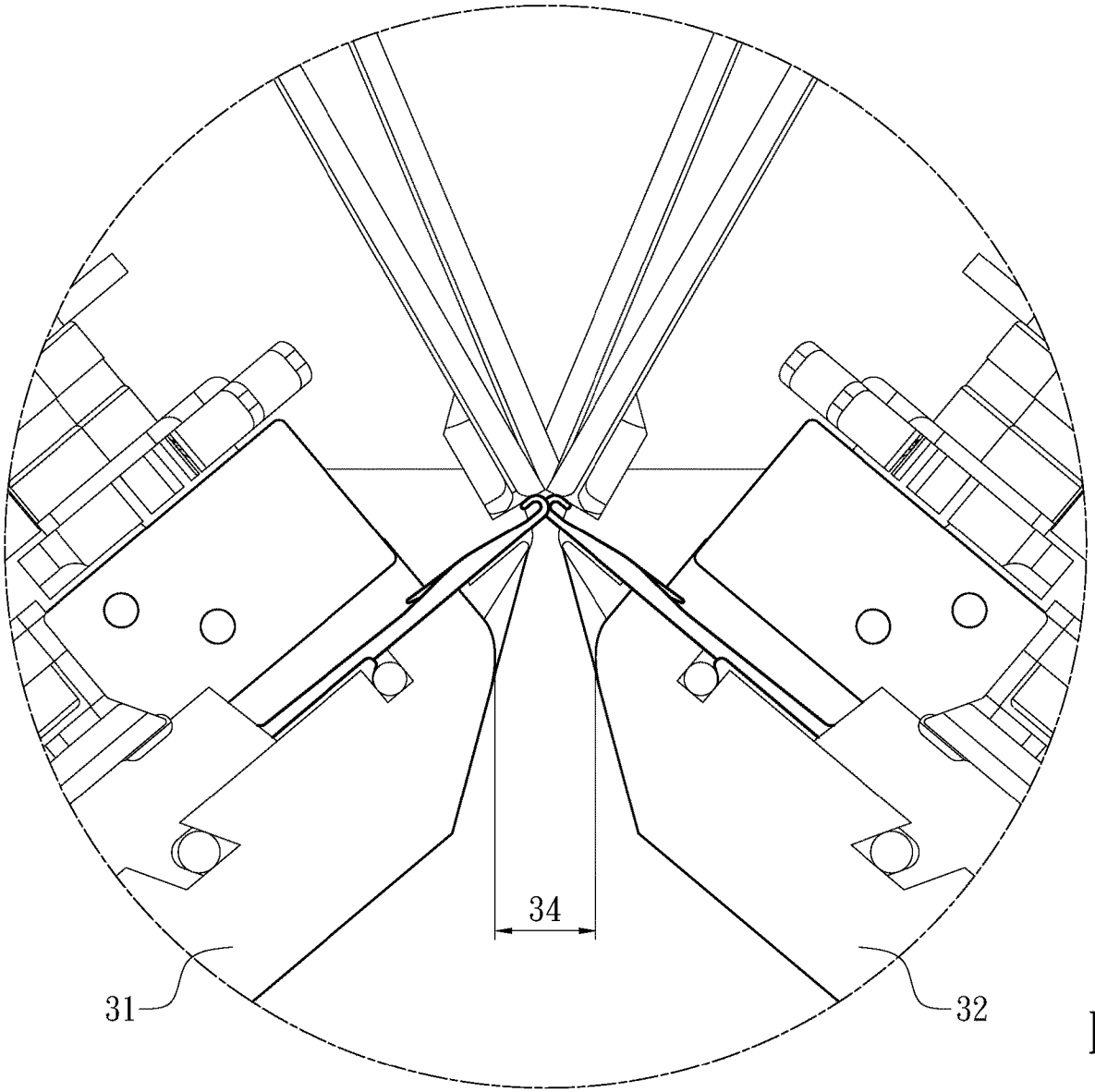
FIG. 6 is a schematic diagram of a mouth of the flat knitting machine knitting the weft-knitted fabric.
Figure 7:
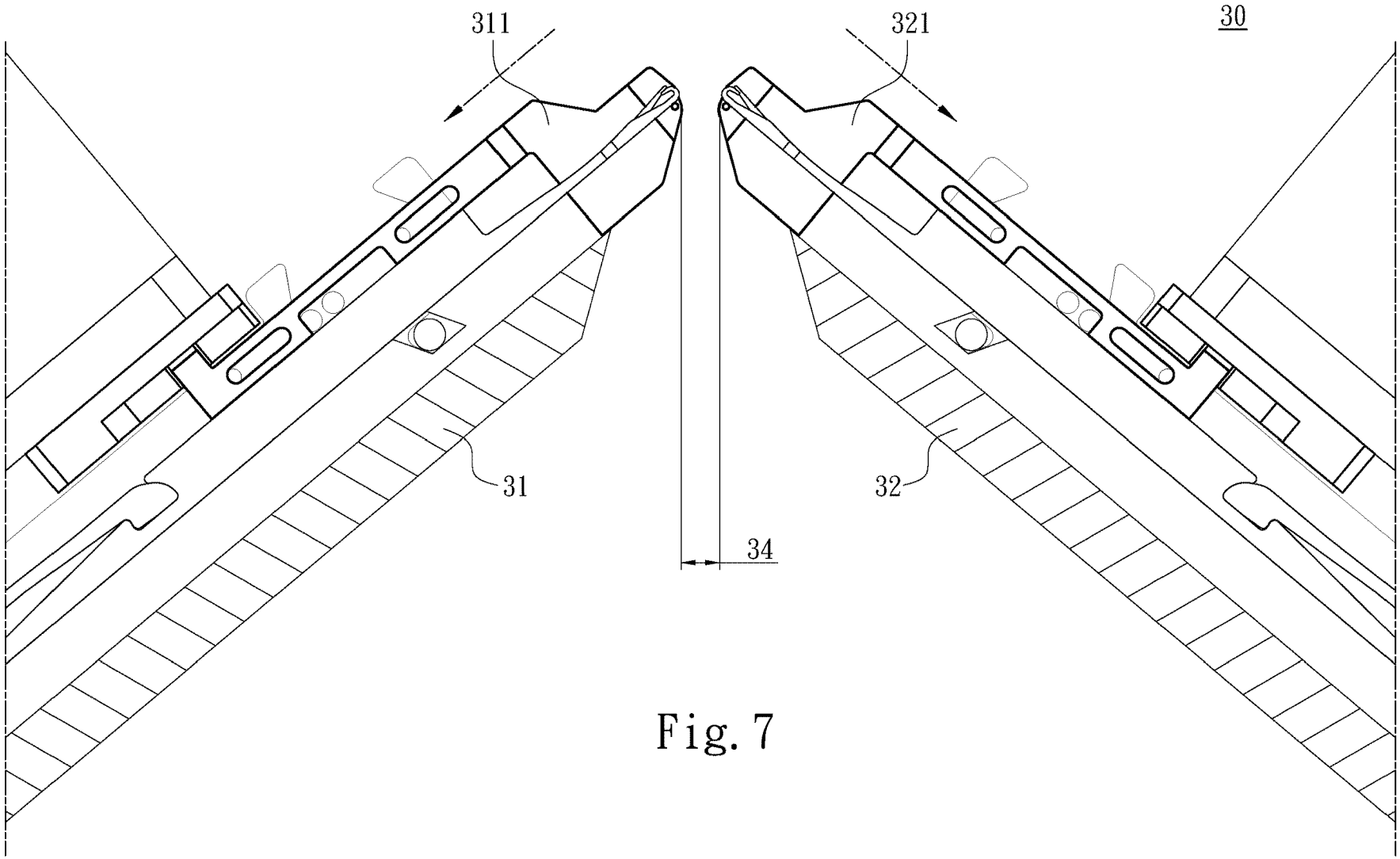
FIG. 7 is a schematic diagram of the flat knitting machine with the mouth capable of changing size.
Figure 8:
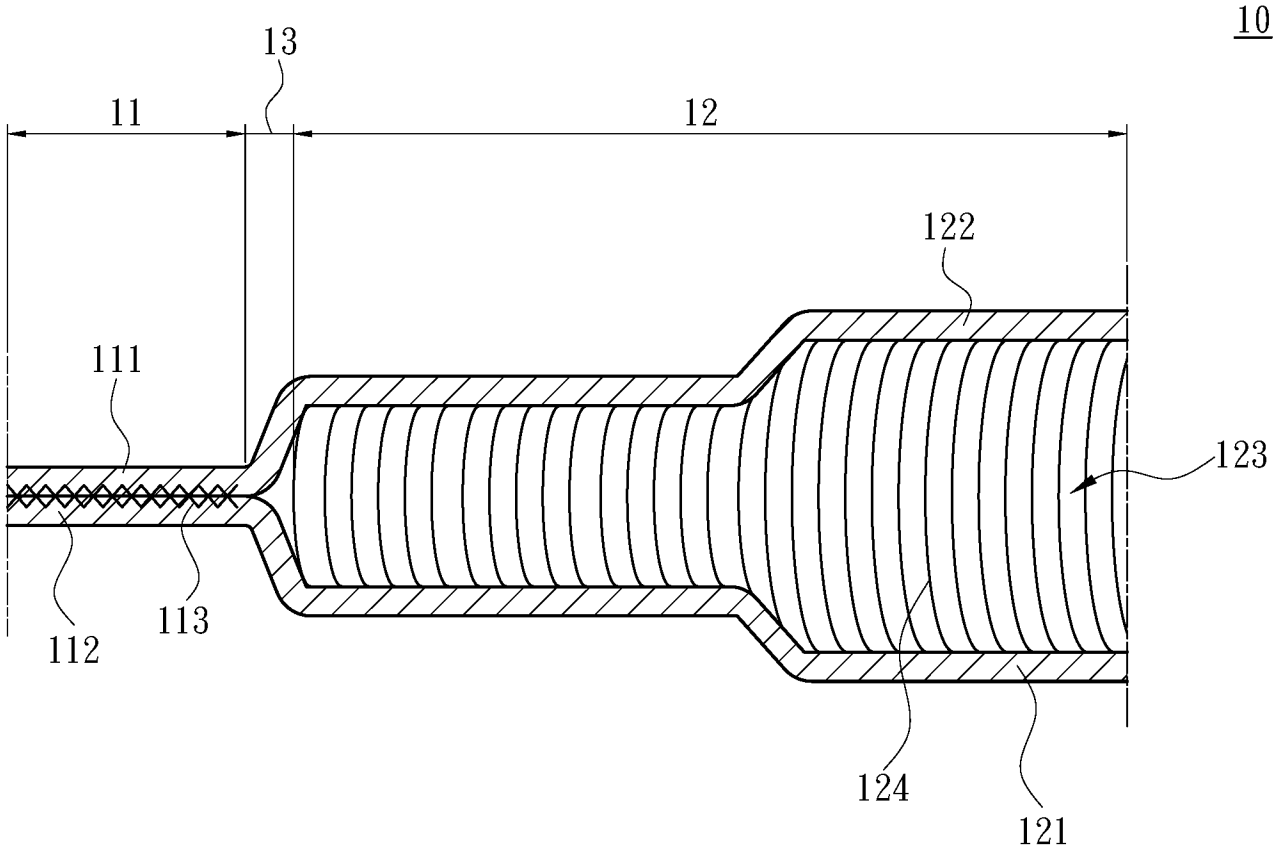
FIG. 8 is a structural diagram of a fourth embodiment of the weft-knitted fabric of the invention.

A thickness of the three-dimensional structure 12 is determined by a length of the supporting yarn 124, and a length of the supporting yarn 124 during knitting process depends on a width of a mouth 34 (shown in FIG. 2 and FIG. 6) of the flat knitting machine 30. It should be understood that changes in a width of the mouth 34 also affect a forming size of yarn loops. When a width of the mouth 34 is larger, knitted yarn loops will become larger, and it will be difficult for excessively large sized yarn loops to form fabric surface structure. Therefore, if a size of the mouth 34 cannot be changed during knitting process, in designing a thickness of the three-dimensional structure 12, a size of yarn loops of the basic structure 11 and the two surface layer portions 121, 122 must be considered. Furthermore, if the flat knitting machine 30 is capable of changing a width of the mouth 34 without stopping knitting during knitting process, the problem that a thickness of the three-dimensional structure 12 being limited by a single width of the mouth 34 can be tackled. The applicant of the invention has provided flat knitting machine structures with variable mouth width during knitting process in Taiwan Patent No. TW 202028555A, TW 202028557A, TW 202028558A, and TW 1707074. Please refer to FIG. 7. When the flat knitting machine 30 is controlled to knit the supporting portion 123 of the three-dimensional structure 12, the flat knitting machine 30 drives two knock-over bits 311, 321 of the two needle beds 31, 32 to displace to change a size of the mouth 34 of the flat knitting machine 30, until a size of the mouth 34 is adjusted to meet the knitting requirements, the flat knitting machine 30 performs knitting of the supporting portion 123. In this way, a height of the supporting portion 123 will no longer be a fixed value, and the three-dimensional structure 12 will no longer have a single thickness but is capable of varying in thickness, as shown in FIG. 8.

Figure 9:
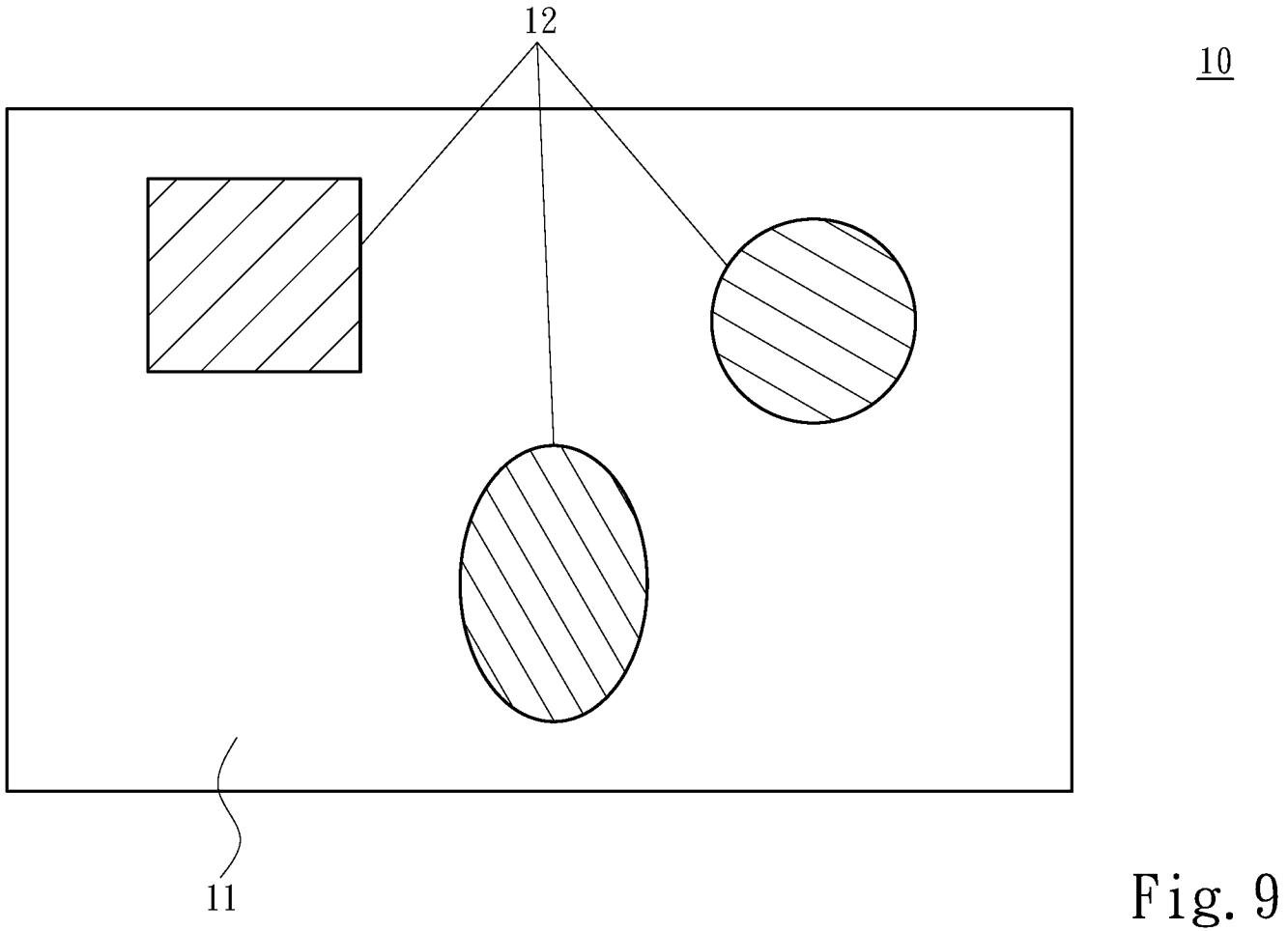
FIG. 9 is a plan view of the weft-knitted fabric of the invention.

Please refer to FIG. 9. The three-dimensional structure 12 on the weft-knitted fabric 10 of the invention does not limit a knitting position, and a knitting position can be determined according to fabric design requirements of the weft-knitted fabric 10.

What is claimed is:

1. A method for knitting and forming a weft-knitted fabric with varying thickness by a flat knitting machine, the method comprising steps of:

driving the flat knitting machine to knit a basic structure by at least one of two needle beds of the flat knitting machine, wherein the basic structure is selected from a single-layer fabric or a double-layer fabric; and controlling the two needle beds on the flat knitting machine to knit a three-dimensional structure connected with the basic structure, wherein a thickness of the three-dimensional structure is greater than a thickness of the basic structure, the three-dimensional structure comprises two surface layer portions and a supporting portion connected with the two surface layer portions and located between the two surface layer portions, wherein the flat knitting machine is controlled to be temporarily suspended from feeding a supporting yarn at a junction between the three-dimensional structure and the basic structure, thus the junction without the supporting portion, and the supporting yarn is fed to form the supporting portion after the two surface layer portions are knitted with a plurality of stitches, and wherein during a process of knitting the supporting portion, the flat knitting machine drives two knock-over bits of the two needle beds to displace and change a size of a mouth of the flat knitting machine, and a height of the supporting portion is not a fixed value.

2. The method for knitting and forming the weft-knitted fabric with varying thickness by the flat knitting machine as claimed in claim 1, wherein when the basic structure is the double-layer fabric, two fabric surfaces of the double-layer fabric are closely attached to each other by tuck knitting or transfer knitting through the flat knitting machine.

3. The method for knitting and forming the weft-knitted fabric with varying thickness by the flat knitting machine as claimed in claim 1, wherein when the basic structure is the double-layer fabric, the flat knitting machine feeds a cross-linking yarn to enable two fabric surfaces of the double-layer fabric closely attaching to each other by an action of the cross-linking yarn, and the cross-linking yarn is without supporting capability.

4. A weft-knitted fabric with varying thickness, comprising:

at least one basic structure, selected from a single-layer fabric or a double-layer fabric; and at least one three-dimensional structure, connected with the basic structure, wherein a thickness of the three-dimensional structure is greater than a thickness of the basic structure, the three-dimensional structure comprising two surface layer portions and a supporting portion connected with the two surface layer portions and located between the two surface layer portions, wherein the supporting portion is formed by at least one supporting yarn which is temporarily suspended to be fed at a junction between the three-dimensional structure and the basic structure, thus the junction is without the supporting portion, wherein the thickness of the three-dimensional structure is determined by a height of the supporting portion, and wherein a height of the supporting portion is not a fixed value, and the height is varied by a change of a size of a mouth of the flat knitting machine.

* * * * *